United States Patent [19]

DeBlois et al.

[11] Patent Number: 4,946,361

[45] Date of Patent: Aug. 7, 1990

[54] HORIZONTAL SCROLL COMPRESSOR WITH OIL PUMP

[75] Inventors: Raymond L. DeBlois; Richard C. Stoeffler, both of Tolland, Conn.; David J. McFarlin, Ellington, Conn.; Howard H. Fraser, Jr., Lafayette, N.Y.

[73] Assignee: Carrier Corporation, Syracuse, N.Y.

[21] Appl. No.: 319,442

[22] Filed: Mar. 6, 1989

[51] Int. Cl.[5] ..... F04C 18/04; F04C 29/02

[52] U.S. Cl. ..... 418/55.6; 418/88; 418/91; 418/94

[58] Field of Search ..... 418/55 A, 55 E, 88, 418/94, 96, 91; 184/6.16

[56] References Cited

U.S. PATENT DOCUMENTS

| | | | |
|---|---|---|---|
| 3,986,799 | 10/1976 | McCullough | 418/88 |
| 4,385,875 | 5/1983 | Kanazawa | 418/63 |
| 4,544,338 | 10/1985 | Takebayashi et al. | 418/63 |
| 4,561,829 | 12/1985 | Iwata et al. | 417/368 |
| 4,568,253 | 2/1986 | Wood | 417/372 |
| 4,626,180 | 12/1986 | Tagawa et al. | 418/63 |
| 4,637,786 | 1/1987 | Matoba et al. | 418/88 |
| 4,712,986 | 12/1987 | Nissen | 418/63 |
| 4,781,542 | 11/1988 | Ozu et al. | 417/369 |

FOREIGN PATENT DOCUMENTS

| | | | |
|---|---|---|---|
| 62-113880 | 5/1987 | Japan | 418/55 E |

*Primary Examiner*—John J. Vrablik
*Attorney, Agent, or Firm*—David J. Zobkiw

[57] ABSTRACT

The motion of the orbiting scroll is used to cause pumping of oil in a hermetic horizontal scroll compressor.

24 Claims, 7 Drawing Sheets

HORIZONTAL SCROLL COMPRESSOR WITH OIL PUMP

BACKGROUND OF THE INVENTION

A hermetic scroll compressor is normally in a vertical orientation so that lubrication for the shaft and orbiting scroll bearings, anti-rotation device, thrust surfaces, etc. is, typically, supplied by a passive centrifugal pump incorporated into the drive shaft. Oil is drawn from a sump which is located at the bottom of the compressor shell and enters the pump through an orifice in the bottom of the shaft. The parts requiring lubrication are, normally, no more than a foot or so above the oil level of the sump so that a small increase in the oil pressure due to its radial acceleration is sufficient to supply the oil to the required locations. This relatively simple, passive lubrication system is a primary reason why hermetic scroll compressors are designed to operate in a vertical position. In this orientation, the compressor height-to-diameter ratio is generally two, or more. By comparison, a typical reciprocating compressor of the same capacity has a height-to-diameter ratio of approximately 1.5.

For many applications, the height of the compressor is a primary factor because of packaging considerations. Very often, the height of an air conditioning, refrigeration or heat pump unit is more important than its width or depth. Accordingly, a distinct advantage could be realized if the scroll compressor could be designed to operate in a horizontal orientation. However, in changing the orientation of a hermetic scroll compressor from a vertical to a horizontal orientation, there are significant changes in the lubrication system and gas flow paths. The motor, crankcase, anti-rotation device and scroll members may extend below the level of the oil in the sump although it is not necessary that all of the members be exposed to the oil sump. The parts to be lubricated are located no more than a few inches above the sump as opposed to a foot, or more, in a vertical unit but the drainage paths are shorter and over different parts. The oil sump blocks some normally used gas paths which are used in cooling the motor and removing entrained oil and some of the drainage paths can contribute to oil entrainment.

SUMMARY OF THE INVENTION

A scroll compressor is horizontally oriented which reduces the height by a half as compared to a vertical unit. Since the oil sump is no longer located at what is now an end, the length of the shell can be reduced by the amount necessary to define the sump and to accommodate the oil pickup tube carried by the crankshaft. Because the crankshaft is no longer acting as a centrifugal pump, the passages used to produce the centrifugal pumping can be simplified and/or eliminated making machining easier and less expensive. The oil pump is of the positive displacement type with the inlet located below the liquid level of the oil sump. The pump is driven by, or is integral with, the orbiting scroll.

It is an object of this invention to provide a horizontal hermetic scroll compressor.

It is another object of this invention to reduce the cubage of a hermetic scroll compressor.

It is a further object of this invention to reduce the overall height of a hermetic scroll compressor.

It is an additional object of this invention to provide improved lubrication in a hermetic scroll compressor.

These objects, and others as will become apparent hereinafter, are accomplished by the present invention.

Basically, a hermetic scroll compressor is located horizontally thereby permitting a length and cubage reduction corresponding to the oil sump of a vertical unit. With the sump located such that the scroll and anti-rotation structure goes beneath the surface of the oil sump, the motion of the orbiting scroll is employed to drive a positive displacement lubrication pump. The lubricating pump pumps the oil to the interfaces between the anti-rotation device and the fixed and orbiting scroll, to the interface between the orbiting scroll and the crankcase and to the bearings supporting the crankshaft and the bushing between the crankshaft and orbiting scroll.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENTS

Figure 1:
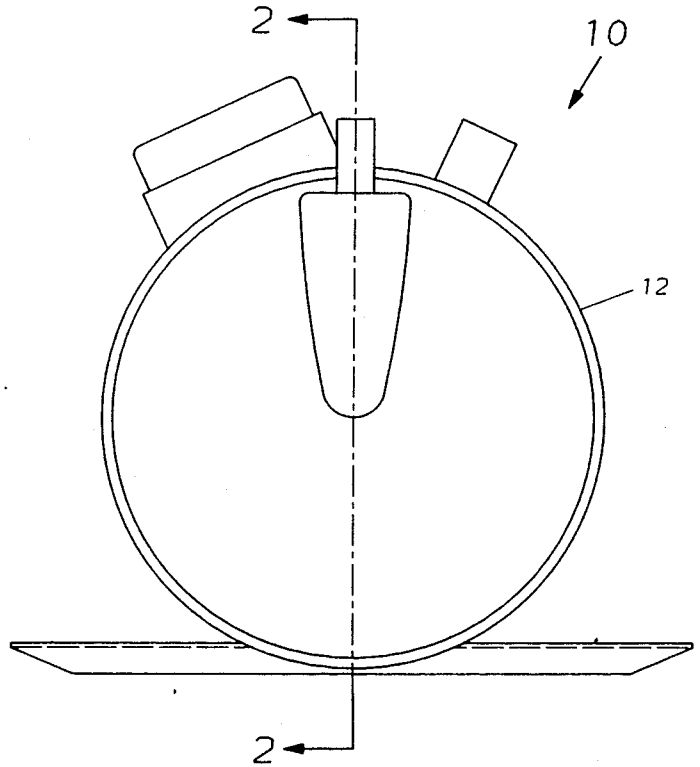
FIG. 1 is an end view of a horizontal scroll compressor.
Figure 2:
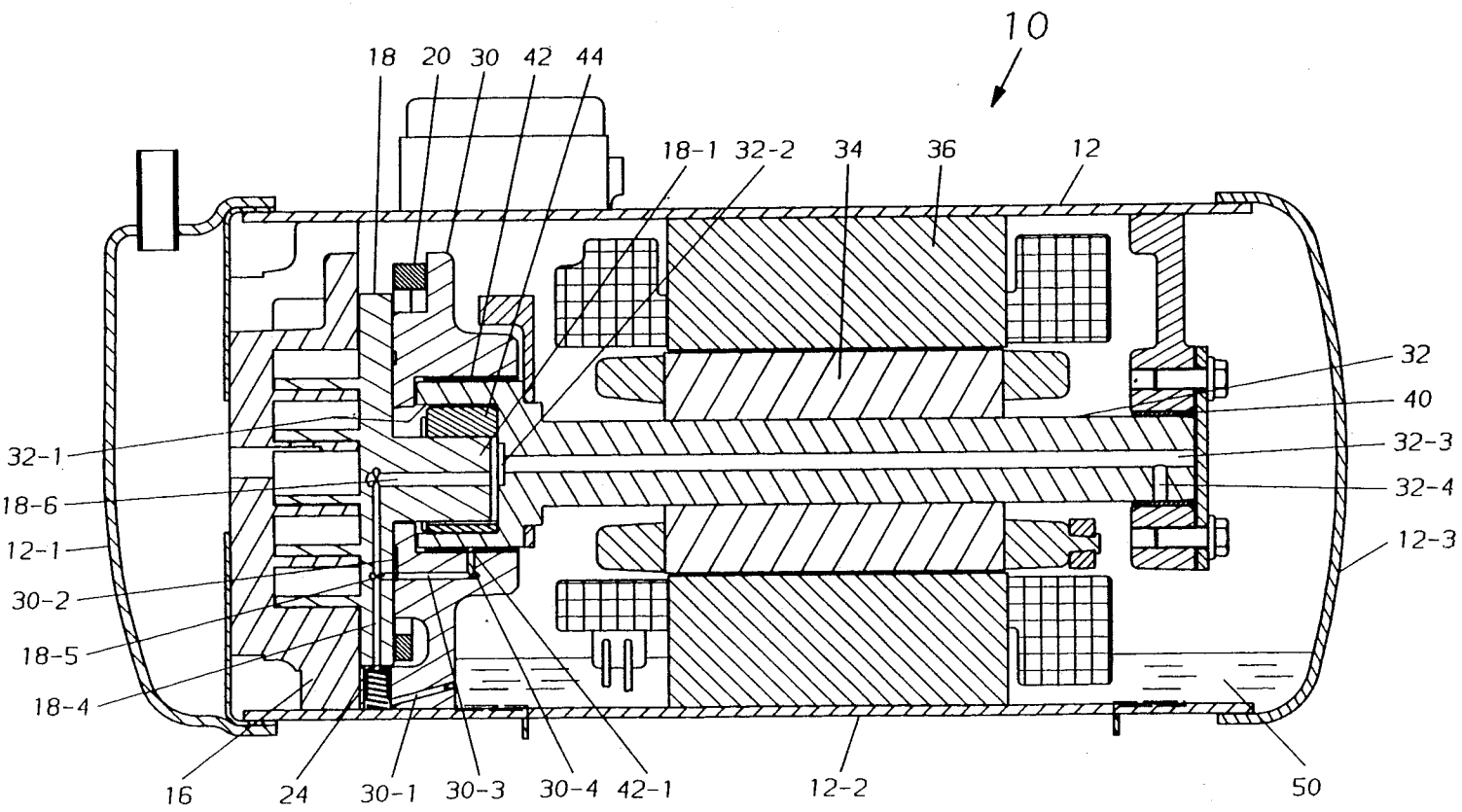
FIG. 2 is a sectional view taken along line 2—2 of FIG. 1.

In FIGS. 1 and 2 the numeral 10 generally designates a low side, horizontal hermetic scroll compressor including a shell 12. A low side compressor is one in which all or most of the interior of shell 12 is at or near suction pressure. The shell 12 is made up of end portions 12-1 and 3 which are welded or otherwise suitably joined to middle portion 12-2. Within shell 12 are fixed scroll member 16, orbiting scroll member 18, anti-rotation device 20 in the form of an Oldham ring or coupling, crankcase 30, crankshaft 32, rotor 34 which is secured to crankshaft 32 and stator 36, as is conventional. Additionally, crankshaft 32 is supported at one end by bearing 40 and is supported at the other end by bearing 42 as well as being connected to boss 18-1 of orbiting scroll 18 via a bushing, sliding block or any other suitable structure 44. The structure so far described is generally that of a vertical hermetic scroll placed horizontally. The first consequence of the changed orientation is the relocation of the oil sump 50 which causes portions of stator 36, crankcase 30, anti-rotation device 20, orbiting scroll 18 and fixed scroll 16 to be located, or potentially located, beneath the level of the oil sump although not necessarily directly exposed to the oil in sump 50. A second consequence is the elimination of the need for crankshaft 32 and/or an oil pickup tube (not illustrated) to extend into an oil sump defined by shell member 12-3. As a result, the shell member 12-3 can be placed closer to the end of crankshaft 32 thereby reducing the length of shell 12 and its cubage. Other consequences are changes in the coaction between bearings 40 and 42 with crankshaft 32 since they now bear the weight of the crankshaft 32 and its carried members on one side, the lowest point, and because the crankshaft 32 no longer needs to provide a centrifugal pumping force to the oil to cause it to be pumped.

In a conventional anti-rotation device 20 of the Oldham coupling type, the Oldham coupling reciprocates with respect to the crankcase 30. Similarly, the orbiting scroll 18 reciprocates with respect to the Oldham coupling 20 but, since the Oldham coupling is also reciprocating at 90° with respect to the direction of reciprocation of the orbiting scroll 18, the net result is an orbiting motion of orbiting scroll 18 with respect to fixed structure in shell 12 such as fixed scroll 16. The motion of the orbiting scroll can be adopted to drive a positive displacement pump according to the teachings of the present invention.

Figure 3:
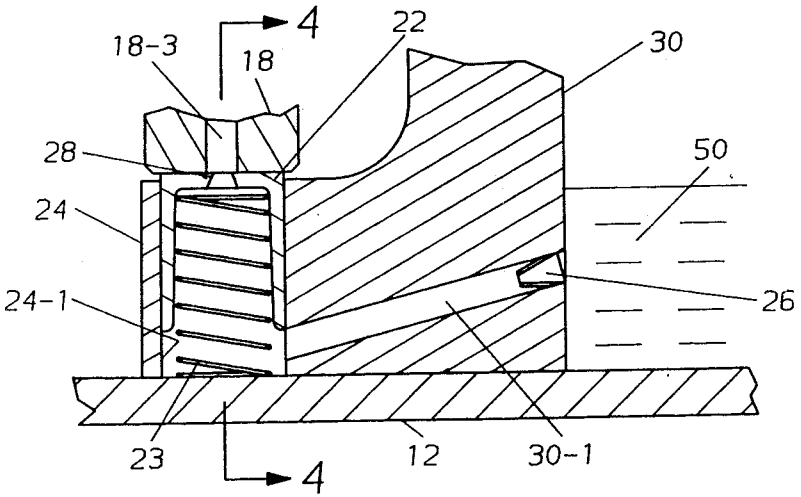
FIG. 3 is an enlarged view of the bottom portion of the orbiting scroll as viewed in FIG. 2.
Figure 4B:
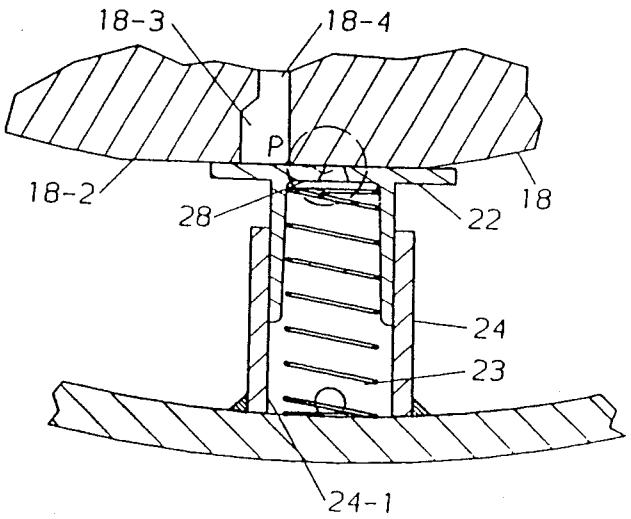
FIGS. 4B–D sequentially represent the movement of the orbiting scroll and pump at 90° intervals starting at and returning to the FIG. 4A position.
Figure 4A:
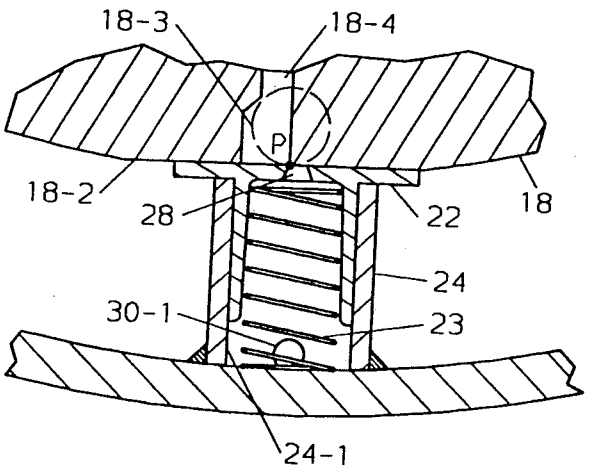
FIG. 4A is a sectional view taken along line 4—4 of FIG. 3.
Figure 4D:
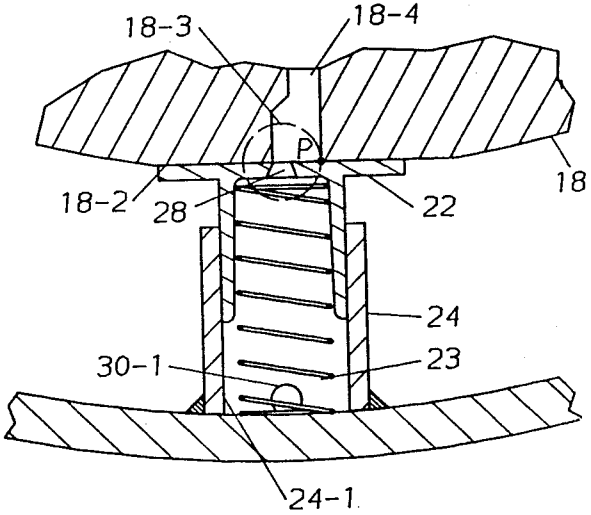
Figure 4C:
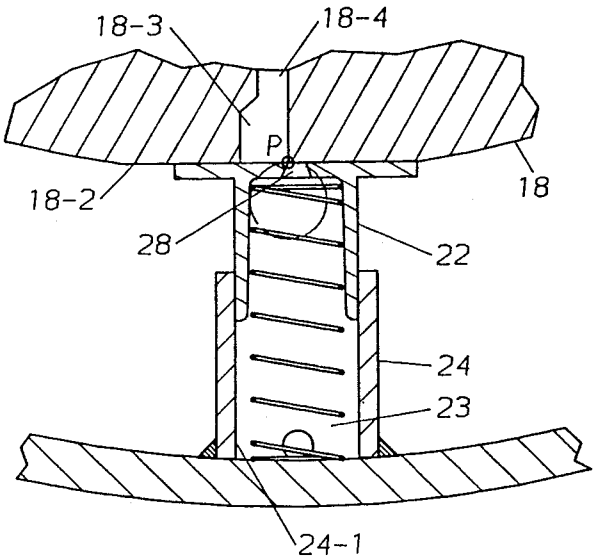

Referring specifically to FIGS. 2, 3 and 4A–D, it will first be noted that the lower portion of the orbiting scroll 18 has been removed to provide a flat surface 18-2. An enlarged passage 18-3 is formed in orbiting scroll 18 at surface 18-2 and the enlarged passage 18-3 transitions into a smaller radial bore 18-4. Flat surface 18-2 is engaged by piston 22 which is spring biased into engagement by spring 23. Hollow piston 22 reciprocates in bore 24-1 in piston cylinder 24 which, as illustrated in FIG. 3, is a part of crankcase 30 but which can be a separate part which is welded or otherwise suitably secured to the interior of shell 12 as illustrated in FIGS. 4A–D. The only differences between FIG. 3 and FIGS. 4A–D is that in FIG. 3 the piston cylinder is part of crankcase 30 whereas it is a separate piece welded in place in FIGS. 4A–D. The coactions are exactly the same. However, if desired bore 24-1 could also be rectangular in cross section with crankcase 30 forming one side. As best shown in FIG. 3, bore 24-1 is always in fluid communication with oil sump 50 via fluid diode 26 which defines the suction inlet and bore 30-1 which extends through crankcase 30 into cylinder 24. Hollow piston 22 has a fluid diode or flow port 28 located in the piston head such that fluid diode or flow port 28 registers with enlarged passage 18-3 in some combinations of positions of the piston 22 and orbiting scroll 18. Referring now to FIGS. 4A–D, it should first be noted that the point P which is located at an intersection of enlarged passage 18-3 and surface 18-2 traces a circle which is shown in phantom and which represents the orbiting path of orbiting scroll 18. Starting with FIG. 4A, orbiting scroll 18 is at its lowest point, representing the end of a discharge stroke/start of a suction stroke, surface 18-2 is blocking fluid diode or flow port 28, and the volume within bore 24-1 and piston 22 is at a minimum. As orbiting scroll 18 moves from the FIG. 4A to the FIG. 4B position, spring 23 maintains piston 22 engaged with surface 18-2 which still blocks fluid diode or flow port 28, the volume within bore 24-1 and piston 22 is increasing so that oil is drawn into bore 24-1 from oil sump 50 via fluid diode 26 and line 30-1. As orbiting scroll 18 goes from the FIG. 4B to the FIG. 4C position, the volume within bore 24-1 and piston 22 continues to increase such that FIG. 4C represents the end of the suction stroke and the beginning of the discharge stroke. As orbiting scroll 18 goes from the FIG. 4C to the FIG. 4D position, fluid diode or flow port 28 becomes uncovered and the volume within bore 24-1 and piston 22 is decreased so that oil is forced through fluid diode or flow port 28 into enlarged passage 18-3. There can be some flow through fluid diode 26 towards oil sump 50 but because of the increased resistance to flow through fluid diode 26 in that direction, most of the flow from bore 24-1 and piston 22 will be through fluid diode or flow port 28. As orbiting scroll 18 goes from the FIG. 4D to the FIG. 4A position, the volume within bore 24-1 and piston 22 continues to decrease and oil is discharged through fluid diode or flow port 28 until the FIG. 4A position is reached and the cycle is repeated. Because surface 18-2 covers fluid diode or flow port 28 in a valving action, it is not necessary that 28 be a fluid diode.

Referring now to FIG. 2, radial bore 18-4 intersects with one end of axial bore 18-5 and terminates at axial bore 18-6. The other end of axial bore 18-5 terminates at annular groove 30-2 which faces orbiting scroll 18. Annular groove 30-2 has an enlarged portion which is always in fluid contact with bore 18-5 as orbiting scroll 18 orbits and is of a size corresponding to the circle of orbit. Axial bore 30-3 extends from the enlarged portion of annular groove 30-2 to radial bore 30-4. Radial bore 30-4 terminates at radial bore 42-1 which extends through bearing 42. Axial bore 18-6 terminates in axial bore 32-1 which contains bushing or sliding block 44. Axial bore 32-1 is connected to axial bore 32-3 through an enlarged counter-bored portion 32-2 whose diameter corresponds in size to the circle of orbit so as to maintain bores 18-6 and 32-3 in continuous fluid communication. Axial bore 32-3 is formed in crankshaft 32 and extends for its length. Bore 32-3 is connected to bearing 40 via radial bore 32-4.

Figure 5B:
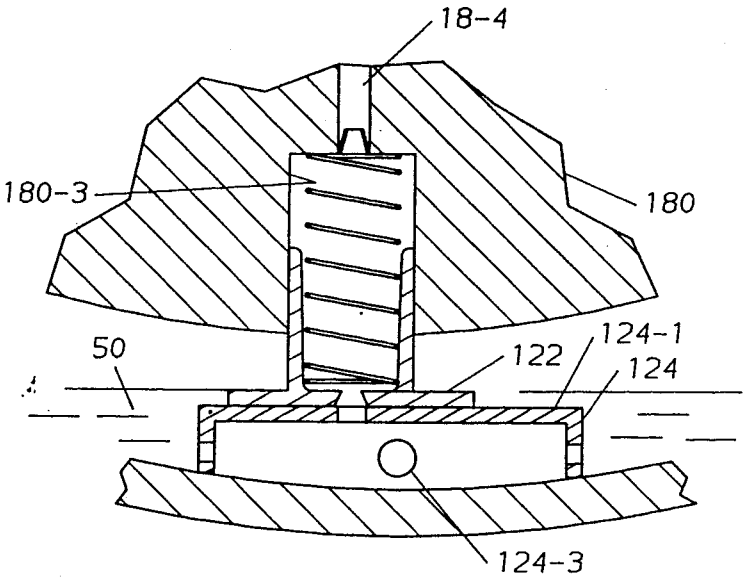
FIGS. 5A–D illustrate a second embodiment of the invention in positions corresponding to FIGS. 4A–D.
Figure 5A:
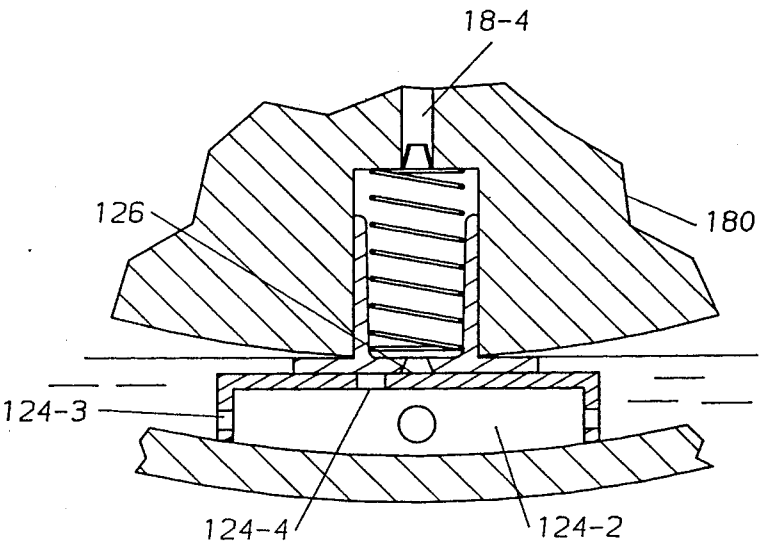
Figure 5D:
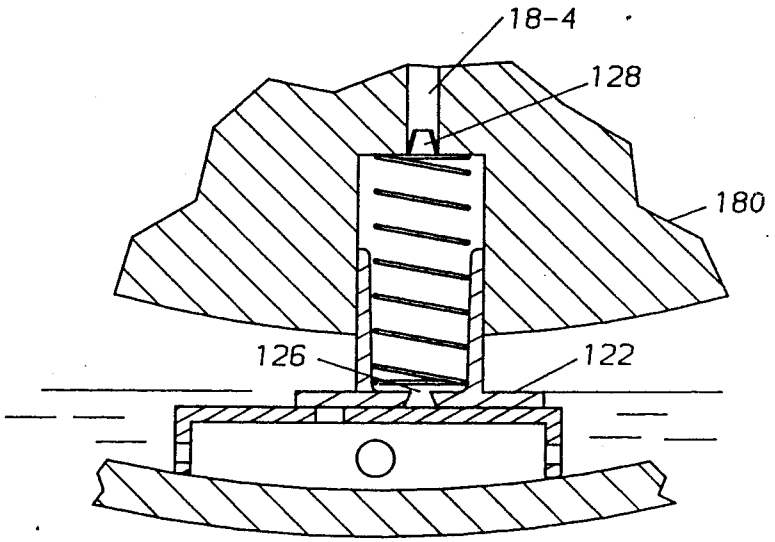

In operation, orbiting scroll 18 orbits due to its coaction with Oldham coupling 20. As orbiting scroll 18 orbits, piston 22 coacts with bore 24-1 as described above with respect to FIGS. 4A–D, drawing oil from the sump 50 via fluid diode 26 and bore 30-1 and discharging it via fluid diode or flow port 28 into enlarged passage 18-3 and then radial bore 18-4 at an elevated pressure which is sufficient to feed the oil to any place in the shell 12 without requiring a further pressure boost. Specifically, bore 18-4 is fluidly connected via axial bore 18-5 to the enlarged portion of annular groove 30-2 at the interface between orbiting scroll 18 and crankcase 30. The pressure of the oil is sufficient to fill groove 30-2 and thereby provide lubrication between the orbiting scroll 18 and crankcase 30. Oil supplied to groove 30-2 also flows into bore 30-3 and passes via bores 30-4 and 42-1 into the interface between bearing 42 and crankshaft 32 which fills with oil and provides lubrication between bearing 42 and crankshaft 32. A portion of the oil supplied to bore 18-4 is supplied to bore 32-1 via bore 18-6. The cavity defined by bore 32-1 of crankcase 32 contains boss 18-1 of orbiting scroll 18 and bushing or sliding block 44 which are lubricated by the oil supplied to bore 32-1. A portion of the oil supplied to bore 32-1 is supplied to bearing 40 via counterbore 32-2, bore 32-3 and bore 32-4. Since the oil is only being pumped several inches, there is no need for a centrifugal boost. FIGS. 5A–D illustrate a modified pump structure where the pump is carried by the orbiting scroll 180 so that piston 122 slides on the surface 124-1 of oil supply housing 124. All unmodified structure has been numbered the same as in the embodiment of FIGS. 2–4. The interior chamber 124-2 of oil supply housing 124 is in fluid communication with oil sump 50 through one or more ports 124-3 and establishes fluid communication with bore 180-3 and the interior of piston 122 via discharge port 124-4 and fluid diode or flow port 126 in the head of piston 122. As in the case of the embodiment of FIGS. 2–4, the fluid diode or fluid port 126 in the head of the piston is covered during the discharge stroke during each orbit of the orbiting scroll and contact between the piston 122 and surface 124-1 is due, at least in part, to the spring bias of spring 23. Although the orbiting scroll 180 is illustrated as fully circular, a flattened surface such as 18-2 of FIG. 4 can be provided. FIGS. 5A–D correspond to FIGS. 4A–D as to their crank and stroke positions. FIG. 5A represents the transition between discharge and suction. The volume in bore 180-3 and piston 122 is at a minimum and piston 122 is held in sliding engagement with surface 124-1 by spring 23 at a position where fluid diode or flow port 126 is just about to register with port 124-4. In going from the FIG. 5A to the FIG. 5B position, fluid diode or flow port 126 comes into registration with port 124-4 and the volume in bore 180-3 and piston 122 increases so that oil is drawn from sump 50 and serially flows through port(s) 124-3, chamber 124-2, port 124-4, and fluid diode 126 into the interior of bore 180-3 and piston 122. It should be noted that fluid diode or flow port 126 in piston 122 defines a suction inlet whereas in FIGS. 3 and 4 fluid diode 28 in piston 22 defines a discharge outlet. Fluid diode 128 in radial bore 18-4 minimizes any reverse flow into bore 180-3 and piston 122 from the lubrication distribution lines. In going from the FIG. 5B to the FIG. 5C position, fluid diode or flow port 126 moves out of registration with port 124-4 completing the suction stroke and the volume within bore 180-3 and piston 122 is at its maximum. In going from the FIG. 5C to the FIG. 5D position, the discharge stroke starts forcing oil from the interior of bore 180-3 and piston 122 through discharge diode 128 into line 18-4 from which it is distributed as described above with respect to FIG. 2. Because fluid diode or flow port 126 is covered by surface 124-1, the resistance to reverse flow by fluid diode or flow port 126 plus the blocking of fluid diode or flow port 126 essentially eliminates any reverse flow as the volume in bore 180-3 and piston 122 decreases during the discharge stroke. Alternatively, because of this valving action between surface 124-1 and flow port 126, port 126 does not have to be a fluid diode. In going from the FIG. 5D to the FIG. 5A position, the discharge stroke goes to completion and the cycle repeats.

Figure 5C:
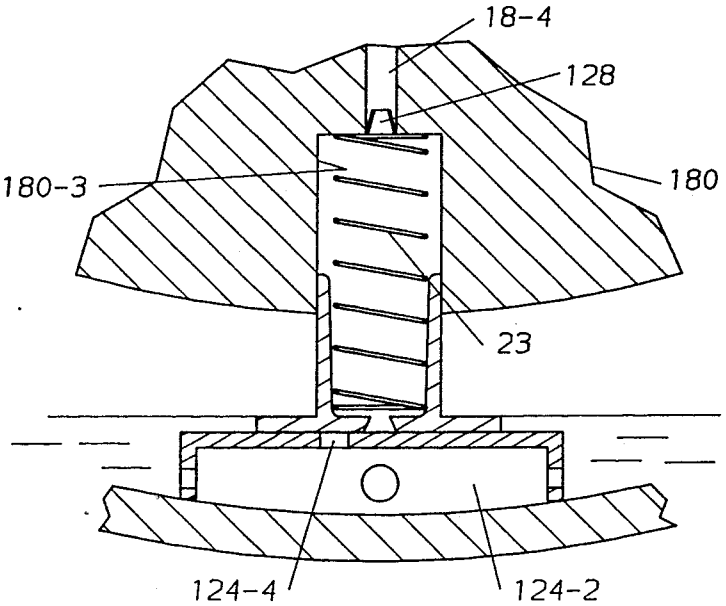
Figure 7:
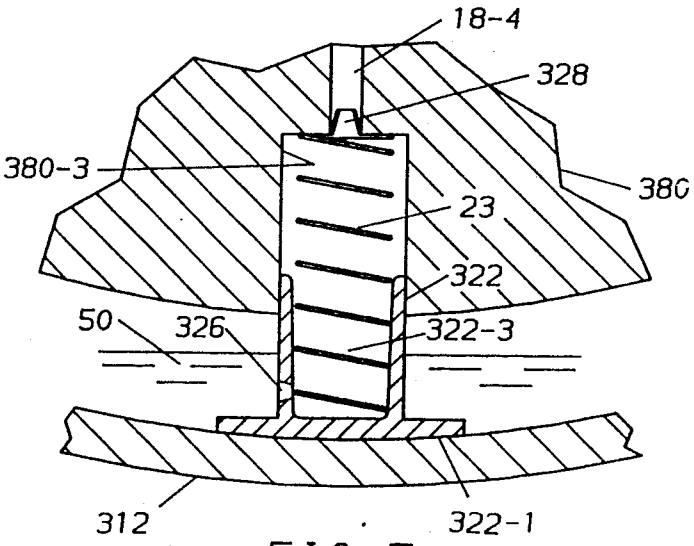
FIG. 7 illustrates a fourth embodiment of the invention in a position corresponding to that of FIG. 4C.
Figure 6:
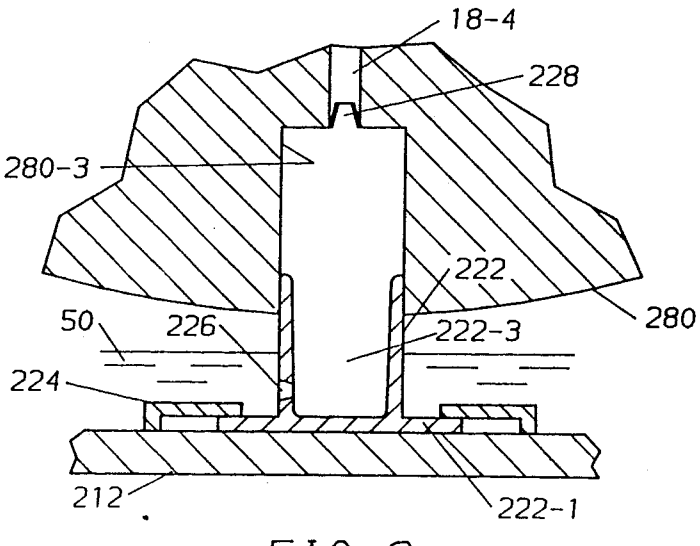
FIG. 6 illustrates a third embodiment of the invention in a position corresponding to that of FIG. 4C.

Referring now to FIG. 6, the piston 222 is in a position corresponding to that of FIGS. 4C and 5C where the transition from suction to discharge takes place. This embodiment eliminates the need for spring 23. Piston 222 includes an enlarged head 222-1 which is guidingly received by piston guide 224 such that piston 222 slides in piston guide 224 and bore 280-3 in accordance with the orbiting motion of orbiting scroll 280. This embodiment requires that shell 212 has a flattened portion or a flat bottomed depression to accommodate the linear, transverse coaction between head 222-1 and piston guide 224. Oil from sump 50 is drawn into the interior chamber 222-3 of piston 222 fluid diode 226 during the suction stroke and passes from bore 280-3 through fluid diode 228 into radial bore 18-4 during the discharge stroke. Oil delivered to radial bore 18-4 is distributed as described with respect to FIG. 2. The embodiment of FIG. 7 is similar to that of FIG. 6 except a spring bias is used rather than a piston guide and piston head 322-1 is rounded to complement the interior of shell 312. The piston 322 is in a position corresponding to that of FIGS. 4C and 5C where the transition from suction to discharge takes place. Piston 322 is held in sliding contact with shell 12 by spring 23 as piston 322 is carried by the orbiting scroll 380 during its orbiting motion. Oil from sump 50 is drawn into the interior chamber 322-3 of piston 322 via fluid diode 326 during the suction stroke and passes from bore 380-3 through fluid diode 328 into radial bore 18-4 during the discharge stroke. Oil delivered to radial bore 18-4 is distributed as described with respect to FIG. 2.

Although a preferred embodiment of the present invention has been illustrated and described, other changes will occur to those skilled in the art. It is therefore intended that the present invention is to be limited only by the scope of the appended claims.

What is claimed is:

1. In a hermetic horizontal scroll compressor including a shell containing a fixed and an orbiting scroll, a crankcase, a crankshaft extending substantially in a horizontal direction, bearings for supporting said crankshaft, means for driving said crankshaft, an anti-rotation means for limiting said orbiting scroll to orbiting motion and an oil sump, a lubrication system comprising:

means defining a piston bore in fluid communication with said oil sump;

piston means reciprocatably located in said piston bore;

a lubrication distribution means in fluid communication with said piston bore for delivering oil to lubricate said orbiting scroll, said crankshaft and said bearings whereby when said orbiting scroll is caused to orbit, said orbiting scroll coacts with said piston means to cause said piston means to reciprocate in said piston bore and thereby pump oil from said sump to said lubrication distribution means.

2. The lubrication system of claim 1 wherein said piston bore is in fluid communication with said oil sump and said lubrication distribution means via fluid diodes.

3. The lubrication system of claim 1 wherein said piston bore is formed in said crankcase.

4. The lubrication system of claim 1 wherein said piston bore is formed in said orbiting scroll.

5. The lubrication system of claim 4 wherein biasing means are located in said piston bore and bias said piston means into sliding contact with said shell.

6. The lubrication system of claim 1 wherein said shell has an inner wall and said piston means is carried by said orbiting scroll such that said piston means moves along said inner wall as said orbiting scroll orbits.

7. The lubrication system of claim 6 further including biasing means for keeping said piston means in contact with said inner wall.

8. The lubrication system of claim 1 wherein biasing means are located in said piston bore and bias said piston means into sliding contact with said orbiting scroll.

9. The lubrication system of claim 1 wherein said piston means has fluid diode means therein and which are located in a fluid path connecting said oil sump with said lubrication distribution means.

10. A hermetic horizontal scroll compressor means comprising;

a shell defining an oil sump;

a fixed and an orbiting scroll, a crankcase, a crankshaft extending substantially in a horizontal direction and anti-rotation means operatively connected within said shell;

bearings supporting said crankshaft;

means defining a vertically extending radial piston bore which extends upwardly from said shell;

piston means reciprocatably located in said piston bore;

a lubrication distribution means;

a first fluid path means between said oil sump and said piston bore and defining a suction supply line for supplying oil to said piston bore;

a second fluid path means in said orbiting scroll between said piston bore and said lubrication distribution means and defining a discharge line for supplying oil to said lubrication distribution means;

said lubrication distribution means including means for supplying oil to provide lubrication between said orbiting scroll and said crankcase and to lubricate said bearings whereby when said orbiting scroll is caused to orbit, said orbiting scroll coacts with said piston means to cause said piston means to reciprocate in said piston bore to cause oil to flow into said piston bore via said first fluid path means and to flow from said piston bore into said second fluid path means.

11. The scroll compressor means of claim 10 wherein at least one of said first and second fluid path means contains a fluid diode.

12. The scroll compressor means of claim 10 wherein said shell has an inner wall and said piston means is carried by said orbiting scroll such that said piston means moves along said inner wall as said orbiting scroll orbits.

13. The scroll compressor means of claim 12 further including biasing means for keeping said piston means in contact with said inner wall.

14. The scroll compressor means of claim 10 wherein said lubrication distribution means includes fluid paths in said crankcase for providing said lubrication between said orbiting scroll and said crankcase and for lubricating at least one of said bearings.

15. The scroll compressor means of claim 10 further including biasing means in said piston bore biasing said piston means into engagement with said orbiting scroll for all operative positions of said orbiting scroll.

16. The scroll compressor means of claim 15 wherein said orbiting scroll has a flattened surface with which said biasing means keeps said piston means in a sliding contact relationship with said second fluid path means being opened and closed during said sliding contact.

17. A hermetic horizontal scroll compressor means comprising:

a shell defining an oil sump;

a fixed and an orbiting scroll, a crankcase, a crankshaft extending substantially in a horizontal direction having a fixed axis of rotation and anti-rotation means operatively connected within said shell;

bearings supporting said crankshaft;

said orbiting scroll defining a vertically extending radial piston bore which extends upwardly from said shell;

piston means reciprocatably located in said piston bore;

a lubrication distribution means;

a first fluid path means between said oil sump and said piston bore and defining a suction supply line for supplying oil to said piston bore;

a second fluid path means in said orbiting scroll between said piston bore and said lubrication distribution means and defining a discharge line for supplying oil to said lubrication distribution means;

said lubrication distribution means including means for supplying oil to provide lubrication between said orbiting scroll and said crankcase and to lubricate said bearings whereby when said orbiting scroll is caused to orbit, said orbiting scroll coacts with said piston means to cause said piston means to reciprocate in said piston bore to cause oil to flow into said piston bore via said first fluid path means and to flow from said piston bore into said second fluid path means.

18. The scroll compressor means of claim 17 wherein said first and second fluid path means contain fluid diodes.

19. The scroll compressor means of claim 17 wherein said lubrication distribution means includes fluid paths in said crankcase for providing said lubrication between said orbiting scroll and said crankcase and for lubricating at least one of said bearings.

20. The scroll compressor means of claim 17 including means for keeping said piston means a fixed radial distance from said fixed axis of rotation as said orbiting scroll orbits.

21. The scroll compressor means of claim 20 wherein said means for keeping is a biasing means.

22. The scroll compressor means of claim 20 wherein said means for keeping is a piston guide.

23. The scroll compressor means of claim 17 wherein said shell has an inner wall and said piston means is carried by said orbiting scroll such that said piston means moves along said inner wall as said orbiting scroll orbits.

24. The scroll compressor means of claim 23 further including biasing means for keeping said piston means in contact with said inner wall.

* * * * *